US010934229B2

(12) United States Patent
Reimer et al.

(10) Patent No.: US 10,934,229 B2
(45) Date of Patent: Mar. 2, 2021

(54) SOLID COMBUSTIBLE PROPELLANT COMPOSITION

(71) Applicant: Goodrich Corporation, Charlotte, NC (US)

(72) Inventors: Karl G. Reimer, Fairfield, CA (US); Jean C. Rodriguez, Vallejo, CA (US)

(73) Assignee: GOODRICH CORPORATION, Charlotte, NC (US)

( * ) Notice: Subject to any disclaimer, the term of this patent is extended or adjusted under 35 U.S.C. 154(b) by 492 days.

(21) Appl. No.: 16/146,154

(22) Filed: Sep. 28, 2018

(65) Prior Publication Data

US 2019/0169083 A1 Jun. 6, 2019

Related U.S. Application Data

(62) Division of application No. 15/074,385, filed on Mar. 18, 2016, now Pat. No. 10,099,968.

(51) Int. Cl.

| | |
|---|---|
| ***D03D 23/00*** | (2006.01) |
| ***D03D 43/00*** | (2006.01) |
| ***C06B 45/10*** | (2006.01) |
| ***C06B 21/00*** | (2006.01) |
| ***C06B 43/00*** | (2006.01) |
| *C06B 29/00* | (2006.01) |

(52) U.S. Cl.
CPC ..... *C06B 45/10* (2013.01); *C06B 21/0025* (2013.01); *C06B 43/00* (2013.01)

(58) Field of Classification Search
USPC ..... 149/19.4, 75, 109.2, 109.4, 109.6
See application file for complete search history.

(56) References Cited

U.S. PATENT DOCUMENTS

| | | | | |
|---|---|---|---|---|
| 3,692,597 | A * | 9/1972 | Brockway et al. | C06B 45/10 149/19.4 |
| 7,726,409 | B2 * | 6/2010 | Haaland | A62C 99/0009 169/43 |
| 2016/0096780 | A1 * | 4/2016 | Mangum | C06B 31/32 149/47 |
| 2016/0096781 | A1 * | 4/2016 | Mangum | C06B 33/06 149/42 |
| 2017/0267601 | A1 | 9/2017 | Reimber | |

* cited by examiner

*Primary Examiner* — James E McDonough
(74) *Attorney, Agent, or Firm* — Cantor Colburn LLP

(57) ABSTRACT

A combustible solid propellant composition is disclosed that includes an oxidizer of the reaction product under vacuum of potassium periodate and isocyanate, a polymer binder, a plasticizer, and a fuel.

16 Claims, 1 Drawing Sheet

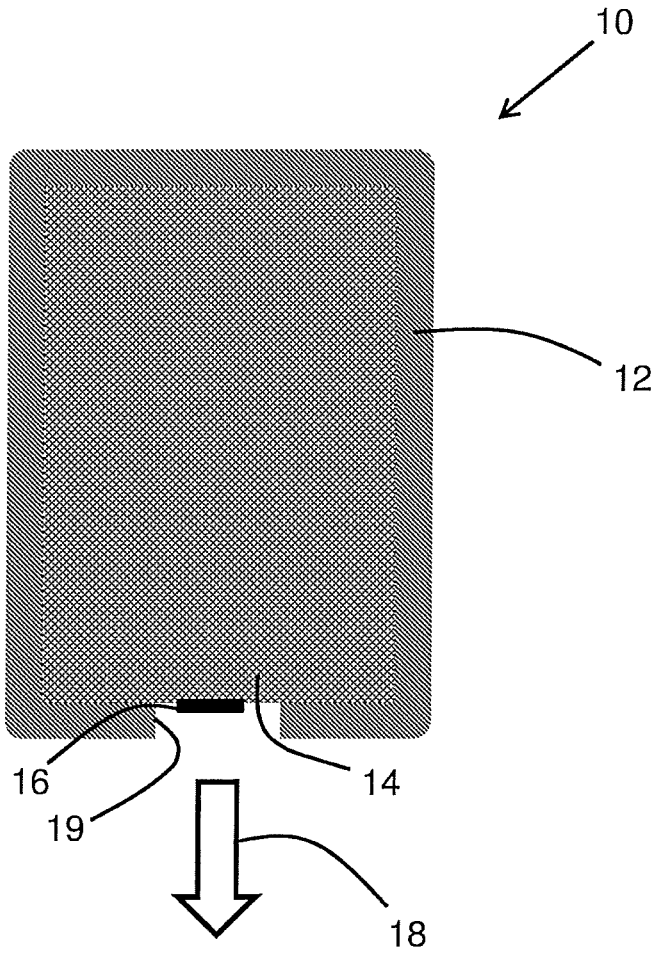
10
12
16
19
14
18

SOLID COMBUSTIBLE PROPELLANT COMPOSITION

CROSS-REFERENCE TO RELATED APPLICATIONS

This application claims the benefit of Non-provisional application Ser. No. 15/074,385 filed Mar. 18, 2016, which is incorporated herein by reference in its entirety.

BACKGROUND

This disclosure relates to solid combustible propellant compositions for a variety of propellant applications.

Combustible solid propellants are well-known for a variety of applications, including but not limited to air bag inflators, inflator cartridges for portable pneumatic tools, rocket propulsion systems, as well as propellants for a variety of ballistic launch systems. Ammonium perchlorate has been widely used as an oxidizer in composite compositions that also include a high-energy fuel and a polymer binder. Ammonium perchlorate offers a number of desired performance features such as processability, good mechanical properties, low pressure exponent, and burning rate. However, perchlorate salts can cause environmental and health problems if released into the environment. Chronic exposure to perchlorates, even in low concentrations, has been shown to cause various thyroid problems. The problems from perchlorate salt in propellants can become acute in areas with localized persistent use of propellant compositions such as at rocket launch sites or munitions test ranges.

In view of the above, there have been efforts to develop combustible solid propellant compositions that utilize oxidizers that do not contain chlorine. Ammonium nitrate has been proposed for use as an alternative oxidizer to ammonium perchlorate. However, the use of ammonium nitrate in propellant applications has been subject to certain difficulties or limitations. For example, ammonium nitrate-containing propellant compositions have been subject to one or more of the following shortcomings: low burn rates, or burn rates exhibiting a high sensitivity to pressure, as well as to phase or other changes in crystalline structure such as may be associated with volumetric expansion such as may occur during temperature cycling over the normally expected or anticipated range of storage conditions. For example, storage conditions for warehoused components or munitions can vary widely in a range from −40° C. to about 110° C. Changes of form or structure of the ammonium nitrate crystalline structure may result in physical degradation of the solid structure or composite of the propellant composition. In particular, ammonium nitrate is known to undergo temperature-dependent changes through five phase changes, i.e., from Phase I through Phase V, with an especially significant volume change of ammonium nitrate associated with the reversible Phase IV to Phase III transition. Furthermore, such changes, even when relatively minute, can strongly influence the physical properties of a corresponding combustible solid propellant and, in turn, adversely affect the burn rate of the combustible solid propellant, to the point of even causing a catastrophic failure during ignition.

It has been found that the phase change-induced degradation of cast, extruded or pelletized ammonium nitrate-containing compositions can be mitigated if the humidity is kept extremely low. However, maintaining such low humidity level is often impractical for most manufacturing situations, so various forms of phase-stabilized ammonium nitrate compositions have been developed. In particular, ammonium nitrate has typically been phase-stabilized by admixture and/or reaction with minor amounts of additional chemical species. For example, U.S. Pat. No. 5,071,630 teaches stabilization with zinc oxide (ZnO), U.S. Pat. No. 5,641,938 teaches stabilization with potassium nitrate ($KNO_3$), and U.S. Pat. No. 5,063,036 teaches stabilization with cupric oxide (CuO). U.S. Pat. No. 6,059,906 teaches stabilization with a molecular sieve age stabilizing agent and a strengthening agent. However, many prior art compositions utilizing alternative oxidizers to ammonium perchlorate suffer from poor burn rate or from a less than optimal combination of various factors such as density, caloric output, specific impulse, and volumetric impulse.

BRIEF DESCRIPTION

In some embodiments of this disclosure, a combustible solid propellant composition comprises an oxidizer comprising the reaction product under vacuum of potassium periodate and isocyanate, a polymer binder, a plasticizer, and a fuel.

In some embodiments, a method of making a combustible solid propellant composition comprises reacting potassium periodate with isocyanate under a vacuum, and mixing the reaction product of the potassium periodate and isocyanate with a polymer binder, a plasticizer, and a fuel.

BRIEF DESCRIPTION OF THE DRAWING

Subject matter of this disclosure is particularly pointed out and distinctly claimed in the claims at the conclusion of the specification. The foregoing and other features, and advantages of the present disclosure are apparent from the following detailed description taken in conjunction with the accompanying drawing, in which the FIGURE is a schematic depiction of a propellant discharge device.

DETAILED DESCRIPTION

As used herein, the combustible propellant composition may also be referred to as simply a propellant composition, even though the propellant is technically not generated until combustion takes place. As mentioned above, the propellant composition comprises an oxidizer comprising potassium periodate that has been reacted with isocyanate under vacuum. In some embodiments, potassium periodate can be the sole oxidizer (i.e., the composition comprises an oxidizer that consists of potassium periodate). In some embodiments, the composition can include other oxidizers that do not have a significant impact on the performance of potassium periodate in the composition (i.e., the composition comprises an oxidizer that consists essentially of potassium periodate). In some embodiments, the composition comprises potassium periodate and other oxidizers without restriction (i.e., the composition comprises an oxidizer that comprises potassium periodate). In some embodiments, if other oxidizers are present, they can be selected from oxygen rich nitrates, periodates, iodates, metal oxides, or dinitramides. Nitrate, iodate, other periodates, and dinitramide salts typically utilize ammonium, alkylammonium, or a metal as cation. Metal cations can include an alkali metal (e.g., potassium), an alkaline earth metal (e.g., strontium), transition or a post-transition metal (e.g., copper or bismuth). Tungsten, zinc, silver, and other non-toxic and environmentally friendly materials can be used as cations. Exemplary useful include cations, salts, and oxidizers that provide densities greater than ammonium nitrate which is 1.95 grams/cm$^3$. Other exemplary useful oxidizers are those with a positive oxygen balance (O.B.) (e.g., potassium periodate has an O.B.=27.8). Useful pairings of cations and anions include bismuth—oxide, cupric—oxide, cupric—nitrate, bismuth-nitrate, lithium—periodate, and ammonium-periodate. Metal oxide oxidizers include oxides of bismuth, copper, tungsten, zinc, molybdenum, and various high density metals. In some embodiments, the metal oxide is capable of being reduced by a metal fuel in the propellant composition. The metal oxides decompose at combustion temperatures to produce oxygen that oxidizes the fuels present in the composition. Specific examples of oxidizers include ammonium nitrate, phased stabilized ammonium nitrate, potassium nitrate, strontium nitrate, bismuth oxide, and potassium dinitramide. In some embodiments, the composition comprises oxidizer in an amount ranging from a minimum of 35 wt. %, more specifically 40 wt. %, and even more specifically 47.5 wt. %, to a maximum of 82 wt. %, more specifically 68 wt. %, and even more specifically 50 wt. %, based on the total amount of the propellant composition. In some embodiments, the above minimum and maximum values can be applied to potassium periodate as the sole oxidizer. In some embodiments, the above minimum and maximum values can be applied to compositions comprising potassium periodate and one or more other oxidizers. In some embodiments, the oxidizer comprises from 50-100 wt. % potassium periodate and from 0-50 wt. % of other oxidizers, based on the total weight of oxidizer. Unless otherwise stated, all weight percentages disclosed herein are based on the total weight of the propellant composition.

As mentioned above, the oxidizer comprises the reaction product under vacuum of potassium periodate and isocyanate. In some embodiments, the potassium periodate is reacted with isocyanate (either a polyisocyanate or a monoisocyanate) prior to mixing with the polymer binder. In some embodiments, the polymer binder is formed by reacting a polyol and a polyisocyanate in the presence of the potassium periodate so that the reaction of potassium periodate and isocyanate occurs with the polyisocyanate curing agent for the polyol, and occurs concurrently with the polymer binder curing reaction. As used herein, "vacuum" means any pressure below atmospheric pressure (i.e., <100 mm Hg). In some embodiments, the vacuum is at a pressure of less than ≤50 mm Hg, more specifically ≤20 mm Hg, and even more specifically ≤5 mm Hg. In some embodiments, the temperature for the reaction between potassium periodate and isocyanate can range from a minimum of 5° C., more specifically 16° C., to a maximum of 100° C., more specifically 35° C. The above minimum and maximum values can be independently combined to disclose a number of different ranges. In some embodiments, the reaction of potassium periodate and isocyanate can provide a surface layer on potassium periodate particles comprising the reaction product of potassium periodate and isocyanate, which can impede further premature reaction of the oxidizer prior to combustion, leaving a core of pure potassium periodate to provide an oxygen source during combustion. In some embodiments, the performance of the reaction under vacuum can impede the formation of voids in the solid composition that can result from off-gassing from the periodate/isocyanate reaction. In some embodiments, the solid propellant composition has less than 3% void space by volume, more specifically less than 0.1% void space by volume.

The fuel in the propellant composition can be provided by a variety of components. The polymer binder is of course a fuel source, and is discussed in further detail below. Additional fuel components can be included in the form of nitroplasticizers, nitraamines, metal powders, dodecaborate salts or other non-nitrated plasticizers. In some embodiments, the composition comprises a fuel in addition to the polymer binder in an amount ranging from a minimum of 11 wt. %, more specifically 13 wt. %, and even more specifically 20 wt. %, to a maximum of 40 wt. %, more specifically 35 wt. %, and even more specifically 32 wt. %, based on the total amount of the propellant composition.

Typical plasticizers may include non-energetic plasticizers which include, but are not limited to, dioctyl adipte (DOA), dibutly phthalate, isodecyl pelargonate etc. or energetic nitroplasticizers which include, but are not limited to nitrate esters, many liquid phase, such as trimethylol ethane trinitrate (TMETN), triethylene glycol dinitrate (TEGDN), triethylene glycol trinitrate (TEGTN), butanetriol trinitrate (BTTN), diethyleneglycol dinitrate (DEGDN), ethyleneglycol dinitrate (EGDN), nitroglycerine (NG), diethylene glycerin trinitrate (DEGTN), dinitroglycerine (DNG), nitrobenzene (NB), N-butyl-2-nitratoethylnitramine (BNEN), methyl-2-nitratoethylnitramine (MNEN), ethyl-2-nitratoethylnitramine (ENEN) or mixtures thereof. In some embodiments, the composition comprises a plasticizer or a mixture of plasticizers (energetic and or non-energetic) in an amount ranging from a minimum of 1 wt. %, more specifically 7 wt. %, and even more specifically 10 wt. %, to a maximum of 30 wt. %, more specifically 22 wt. %, and even more specifically 18 wt. %, based on the total amount of the propellant composition.

In some embodiments, the fuel includes one or more metal powders. As used herein, the term "metal powder" includes powders of metals and of metal hydrides. Examples of metal powders include but are not limited to aluminum, tin, magnesium, zirconium, zirconium hydride, titanium, titanium hydride, aluminum-silicon alloy, magnesium-aluminum alloy, and boron or mixtures/alloys thereof. Particle sizes of the metal powders can range from about 10 nanometers to about 20 μm to, and more specifically from about 2 μm to about 10 μm. The amounts and particle sizes of metal fuel can vary depending on system design parameters. Generally, larger amounts of metal fuel increase combustion temperature and volumetric impulse, but in too large of an amount they can cause metal oxide precipitate in the propellant exhaust, which can reduce velocity and lead to equipment fouling and breakdown. In some embodiments, the composition comprises a metal powder in an amount ranging from a minimum of 0.4 wt. %, more specifically 4 wt. %, and even more specifically 8 wt. %, to a maximum of 40 wt. %, more specifically 28 wt. %, and even more specifically _20_ wt. %, based on the total amount of the propellant composition. In some embodiments, the composition comprises titanium hydride in an amount ranging from a minimum of 1 wt. %, more specifically 4 wt. %, and even more specifically 8 wt. %, to a maximum of 40 wt. %, more specifically 23 wt. %, and even more specifically 16 wt. %, based on the total amount of the propellant composition. In some embodiments, the amount of aluminum is limited to less than or equal to 0.5 wt. %, more specifically 3 wt. %, and even more specifically 4 wt. %. In some embodiments, the amount of tin is limited to less than or equal to 0.5 wt. %, more specifically 3 wt. %, and even more specifically 4 wt. %.

A dodecaborate salt can also be included as a fuel component. A dodecaborate salt is a salt of dodecahydrodecaboric acid such as cesium dodecaborate, potassium dodecaborate, sodium dodecaborate, lithium dodecaborate, ammonium dodecaborate, or tetralkylammonium dodecaborate. The salts can be characterized by the formula $M^{+2}[B_{12}H_{12}]^{-2}$ where M is a metal or ammonium in a stoichiometric amount to balance the −2 charge of the dodecaborate anion. Dodecaborate salts are available from commercial chemical suppliers. In some embodiments, the composition comprises a dodecaborate salt in an amount ranging from a minimum of 0.5 wt. %, more specifically 3 wt. %, and even more specifically 6 wt. %, to a maximum of 25 wt. %, more specifically 15 wt. %, and even more specifically 13 wt. %, based on the total amount of the propellant composition. These endpoints can be independently combined.

Boron can also be included as a fuel component. In some embodiments, the composition comprises boron in an amount ranging from a minimum of 0.5 wt. %, more specifically 3 wt. %, and even more specifically 6 wt. %, to a maximum of 25 wt. %, more specifically 15 wt. %, and even more specifically 13 wt. %, based on the total amount of the propellant composition. These endpoints can be independently combined. In some embodiments, the composition can include a dodecaborate salt and boron. In some embodiments, the composition can include a 1-99 wt. % dodecaborate salt and 99-1 wt. % boron, the weight percentages based the total amount of dodecaborate salt and boron.

The polymer binder of the propellant composition can be a thermoplastic it can be a thermoset composition that relies on a chemical curing mechanism. In some embodiments, the composition comprises polymer binder in an amount ranging from a minimum of 7.9 wt. %, more specifically 8.3 wt. %, and even more specifically 8.9 wt. %, to a maximum of 17 wt. %, more specifically 15 wt. %, and even more specifically 13.9 wt. %, based on the total amount of the propellant composition. Thermoset polymer binder compositions can contain one or more resins having polyfunctional groups (e.g., polyols) that react with other resin functional groups or with a polyfunctional curing agent (e.g., polyisocyanates) having groups reactive with the resin functional groups. Examples of polyfunctional resins include hydroxyl-terminated polybutadiene (HTPB), hydroxy-terminated polyether (HTPE), polyglycol adipate (PGA), polyester diols, polycaprolactone (PCL), glycidylazide polymer (GAP), poly bis-3,3'-azidomethyl oxetane (BAMO), poly-3-nitratomethyl-3-methyl oxetane (PNMMO), polyethylene glycol (PEG), polypropylene glycol (PPG), cellulose acetate (CA) or mixtures thereof. Curing agents include, but are not limited to, hexamethylene diisocyanate (HMDI), isophorone diisocyanate (IPDI), toluene diisocyanate (TDI), trimethylxylene diisocyanate (TMDI), dimeryl diisocyanate (DDI), diphenylmethane diisocyanate (MDI), naphthalene diisocyanate (NDI), dianisidine diisocyanate (DADI), phenylene diisocyanate (PDI), xylylene diisocyanate (MXDI), other diisocyanates, triisocyanates, higher isocyanates than the triisocyanates, polyfunctional isocyanates (e.g., Desmodur N 100), other polyfunctional isocyanates or mixtures thereof. In some embodiments, the curing agent has least two reactive isocyanate groups. If there are no binder ingredients with a functionality that is greater than 2, then the curative functionality (e.g., number of reactive isocyanate groups per molecule of isocyanate curing agent) must be greater than 2.0. If there are binder polymers with a functionality of two or less, then an isocyanate with functionality greater than two may be used. The amount of the curing agent is determined by the desired stoichiometry (i.e., stoichiometry between curable binder and curing agent). In some embodiments, the curing agent is present in the propellant composition in an amount of about 0.5 wt. % to about 5%.

The combustible solid propellant composition can be prepared by blending the above-described components, i.e., oxidizer, fuel, polymer binder (or components thereof, e.g., polyfunctional resin and polyfunctional curing agent), dodecaborate salt, and any additional or optional components in a mixing vessel. During the working time of the uncured resin composition, the mixture can be molded or cast into a desired shape or extruded and pelletized. After cure of the polymer binder is complete, the solid propellant can be fitted into a propellant module for use in various applications such as an airbag inflator or a rocket motor. An exemplary propellant module is depicted in the FIGURE, where propellant module 10 has a housing or vessel 12 with a solid propellant composition 14 therein. Upon activation of combustion by ignition device 16 (e.g., an electronic ignition device), combustion of the solid propellant composition 14 produces combustion gases 18 that are exhausted as propellant through opening 19.

Other additives can be included as well, as known in the art, including but not limited to cure catalysts (e.g., triphenyl bismuth or butyl tin dilaurate, a metal acetylacetonate), nitrate ester stabilizers (e.g., N-methyl-4-nitroaniline (MNA), 2-nitrodiphenylamine, (NDA), ethyl centralite (EC), antioxidants (e.g., 2,2'-bis(4-methyl-6-t-butylphenol)) and amorphous carbon powder.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A method of making a solid combustible propellant composition, comprising reacting potassium periodate with isocyanate under a vacuum; and mixing the reaction product of the potassium periodate and isocyanate with a polymer binder, a plasticizer, and a fuel.

2. The method of claim 1, further comprising reacting a polyol with a polyisocyanate to form the polymer binder.

3. The method of claim 2, comprising reacting the polyol with the polyisocyanate in the presence of the potassium periodate.

4. The method of claim 2, wherein the polyol, polyisocyanate, and potassium periodate are reacted together under vacuum.

5. The method of claim 2, wherein the plasticizer comprises a nitrate ester plasticizer.

6. The method of claim 1, wherein the vacuum is at a pressure of less than 20 mm Hg.

7. The method of claim 1, wherein the vacuum is at a pressure of less than 5 mm Hg.

8. The method of claim 1, wherein the oxidizer comprises potassium periodate particles with an outer surface that comprises the reaction product of potassium periodate and isocyanate.

9. The method of claim 1, wherein the fuel comprises a metal powder.

10. The method of claim 1, wherein the fuel comprises titanium hydride.

11. The method of claim 1, wherein the fuel comprises a dodecaborate salt.

12. The method of claim 1, wherein the fuel comprises boron.

13. The method of claim 1, wherein the fuel comprises titanium hydride, a dodecaborate salt, and aluminum.

14. The method of claim 1, wherein the solid combustible propellant composition comprises 40-72 wt. % oxidizer, 9-14.5 wt. % polymer binder, and 22-30 wt. % fuel, based on the total weight of the composition.

15. The method of claim 14, wherein the oxidizer comprises 100 wt. % potassium periodate, based on the total weight of oxidizer.

16. The method of claim 1, wherein the solid combustible propellant composition comprises 45-58 wt. % potassium periodate, 9.2-14.2 wt. % binder comprising the reaction product of a polyol and a polyisocyanate, 4-16.2 wt. % nitrate ester plasticizer, 0.4-12 wt. % aluminum, 5-20 wt. % titanium hydride, 1-15 wt. % dodecaborate salt, and 0-10 wt. % boron, based on the total weight of the composition.

* * * * *